US005699942A

United States Patent [19]

Thompson et al.

[11] Patent Number: 5,699,942

[45] Date of Patent: Dec. 23, 1997

[54] AUTOMATIC SLEEVE INVERTOR

[75] Inventors: Ken J. Thompson, Lexington; John R. Everhart; Wayne G. Foster, both of Winston-Salem; Joel C. Rosenquist, Kernersville, all of N.C.

[73] Assignee: Sara Lee Corporation, Winston-Salem, N.C.

[21] Appl. No.: 505,096

[22] Filed: Jul. 21, 1995

[51] Int. Cl.[6] ..... A41H 43/00

[52] U.S. Cl. ..... 223/42; 223/40; 223/41; 223/43; 223/39

[58] Field of Search ..... 223/42, 41, 40, 223/39, 43

[56] References Cited

U.S. PATENT DOCUMENTS

| | | | |
|---|---|---|---|
| 2,116,569 | 5/1938 | Gold | 223/42 |
| 3,643,840 | 2/1972 | LeBlane | 223/42 |
| 3,945,542 | 3/1976 | Taylor | 223/42 |
| 4,784,070 | 11/1988 | Thurner et al. | 223/42 |
| 5,106,000 | 4/1992 | Small et al. | 223/42 |
| 5,127,558 | 7/1992 | Paolo | 223/42 |

FOREIGN PATENT DOCUMENTS

| | | | |
|---|---|---|---|
| 21716 | 3/1935 | U.S.S.R. | 223/40 |
| 147555 | 3/1962 | U.S.S.R. | 223/42 |

OTHER PUBLICATIONS

0128816, EPO Patent Document, May 1984, Letard et al.

*Primary Examiner*—Bibhu Mohanty

*Attorney, Agent, or Firm*—Rhodes Coats & Bennett, L.L.P.

[57] ABSTRACT

An apparatus for automatically inverting a garment piece for a sweat suit or the like. The apparatus includes an elongated tube for receiving the garment piece over the front end of the tube. A gripper arm is located adjacent to the rear end of the tube and axially aligned with the tube. The gripper arm includes an elongated arm attached to a frame at one end; gripping means attached to the other end of the elongated arm; and means for moving the arm and the gripping means from a first position away from the garment piece to a second position adjacent to the garment piece. A spreader engages the garment piece adjacent to the front end of the tube to position the garment piece for the gripper means. The gripper means and arm are operable to grasp and withdraw the garment piece through the front end of the tube to the rear end of the tube to automatically invert the garment piece.

38 Claims, 6 Drawing Sheets

AUTOMATIC SLEEVE INVERTOR

BACKGROUND OF THE INVENTION (1) Field of the Invention

The present invention relates generally to automated manufacturing systems and, more particularly, to an apparatus for automatically inverting a sleeve or pant leg for a sweat suit or the like.

(2) Description of the Prior Art

The manufacture of textile clothing articles such as sweat suits and outer garments has resisted automation. This is due largely because of the difficulty in accurately handling so called "soft" materials. For example, the fleece material commonly used in sweat suits may wrinkle, stick to one another and stretch significantly when handled.

Even where automation has begun to make in-roads, other difficulties remain. For example, sleeves and pant legs must be sewn "inside out" in order to make a garment having clean seams. Therefore, after sewing is completed, the garment must be inverted before final assembly and packaging. This has always been a manual operation because of the dexterity required to reach down through a sleeve or pant leg, find and grasp the end, and pull the end through the garment piece. Unfortunately, repetitive actions such as inverting a garment may cause health problems. However, it has been extremely difficult to design a device which can reliably locate and grasp the end of the garment time after time.

Thus, there remains a need for an apparatus for automatically inverting a sleeve or pant leg for a sweat suit or the like which will operate reliably time after time while, at the same time, it can be carried out completely automatically without the need for a skilled operator.

SUMMARY OF THE INVENTION

The present invention is directed to an apparatus for automatically inverting a garment piece for a sweat suit or the like. The apparatus includes an elongated tube attached to a frame having a front end and a rear end for receiving the garment piece over the front end of the tube. A gripper arm is located adjacent to the rear end of the tube and axially aligned with the tube. The gripper arm includes an elongated arm attached to a frame at one end; gripping means attached to the other end of the elongated arm; and means for moving the arm and the gripping means from a first position away from the garment piece to a second position adjacent to the garment piece. A spreader engages the garment piece adjacent to the front end of the tube to position the garment piece for the gripper means, whereby the gripper means and arm are operable to grasp and withdraw the garment piece through the front end of the tube to the rear end of the tube to automatically invert the garment piece.

Accordingly, one aspect of the present invention is to provide an apparatus for automatically inverting a garment piece for a sweat suit or the like. The apparatus includes: (a) a frame; (b) an elongated tube attached to the frame having a front end and a rear end for receiving the garment piece over the front end of the tube; (c) an elongated arm located adjacent to the rear end of the tube and axially aligned with the tube and movable from a first position extending from the rear to the front portion of the tube to a second position rearward of the tube; and (d) gripper means attached to one end of the arm, whereby the gripper means and arm are operable to grasp and withdraw the garment piece through the front end of the tube to the rear end of the tube to automatically invert the garment piece.

Another aspect of the present invention is to provide an elongated gripper arm for grasping and pulling a garment piece. The arm includes: (a) a frame; (b) an elongated arm attached to the frame at one end; (c) gripping means attached to the other end of the elongated arm; and (d) means for moving the arm and the gripping means from a first position away from the garment piece to a second position adjacent to the garment piece.

Still another aspect of the present invention is to provide an apparatus for automatically inverting a garment piece for a sweat suit or the like. The apparatus includes: (a) a frame; (b) an elongated tube attached to the frame having a front end and a rear end for receiving the garment piece over the front end of the tube; (c) a gripper arm located adjacent to the rear end of the tube and axially aligned with the tube, the gripper arm including: (i) a frame; (ii) an elongated arm attached to the frame at one end; (iii) gripping means attached to the other end of the elongated arm; and (iv) means for moving the arm and the gripping means from a first position away from the garment piece to a second position adjacent to the garment piece; (d) spreader means for engaging the garment piece adjacent to the front end of the tube to position the garment piece for the gripper means, whereby the gripper means and arm are operable to grasp and withdraw the garment piece through the front end of the tube to the rear end of the tube to automatically invert the garment piece.

These and other aspects of the present invention will become apparent to those skilled in the art after a reading of the following description of the preferred embodiment when considered with the drawings.

DESCRIPTION OF THE PREFERRED EMBODIMENTS

Figure 1:
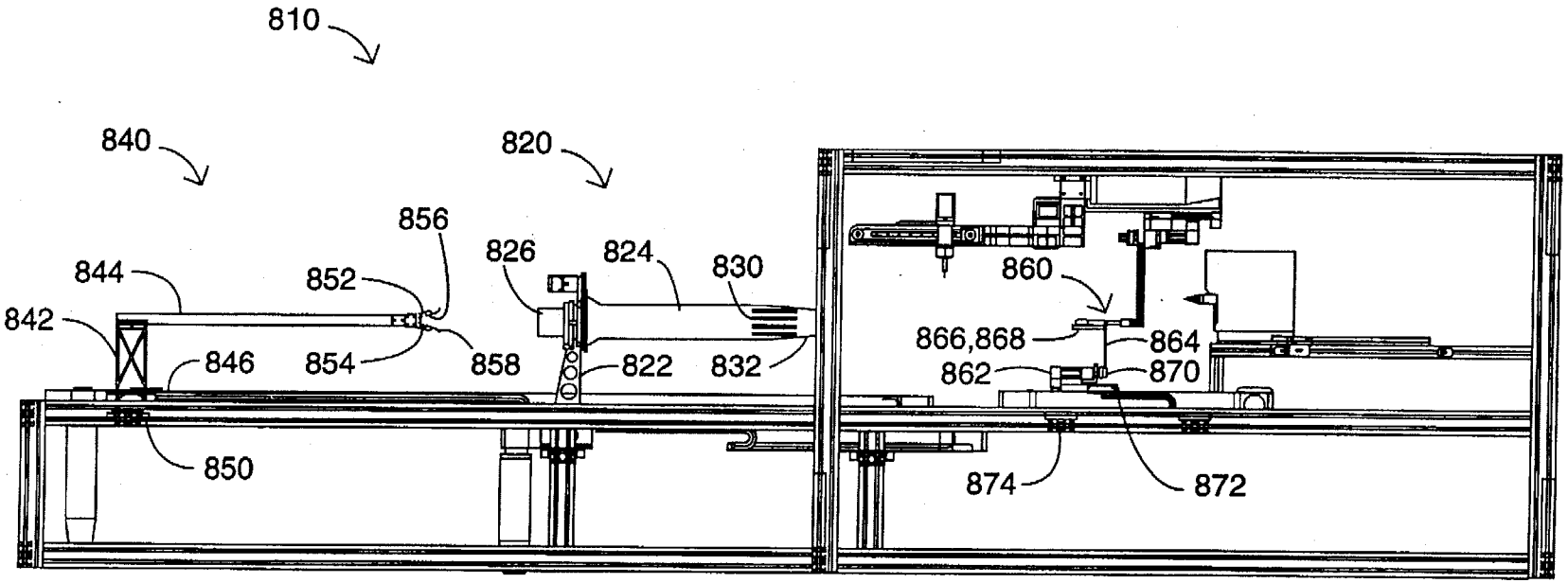
FIG. 1 is a side elevational view of a sleeve invertor constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, sleeve invertor, generally designated 810, is shown constructed according to the present invention. The sleeve invertor 810 includes three major subassemblies: an elongated tube assembly 820; a gripper arm assembly 840; and a spreader assembly 860.

Figure 2:
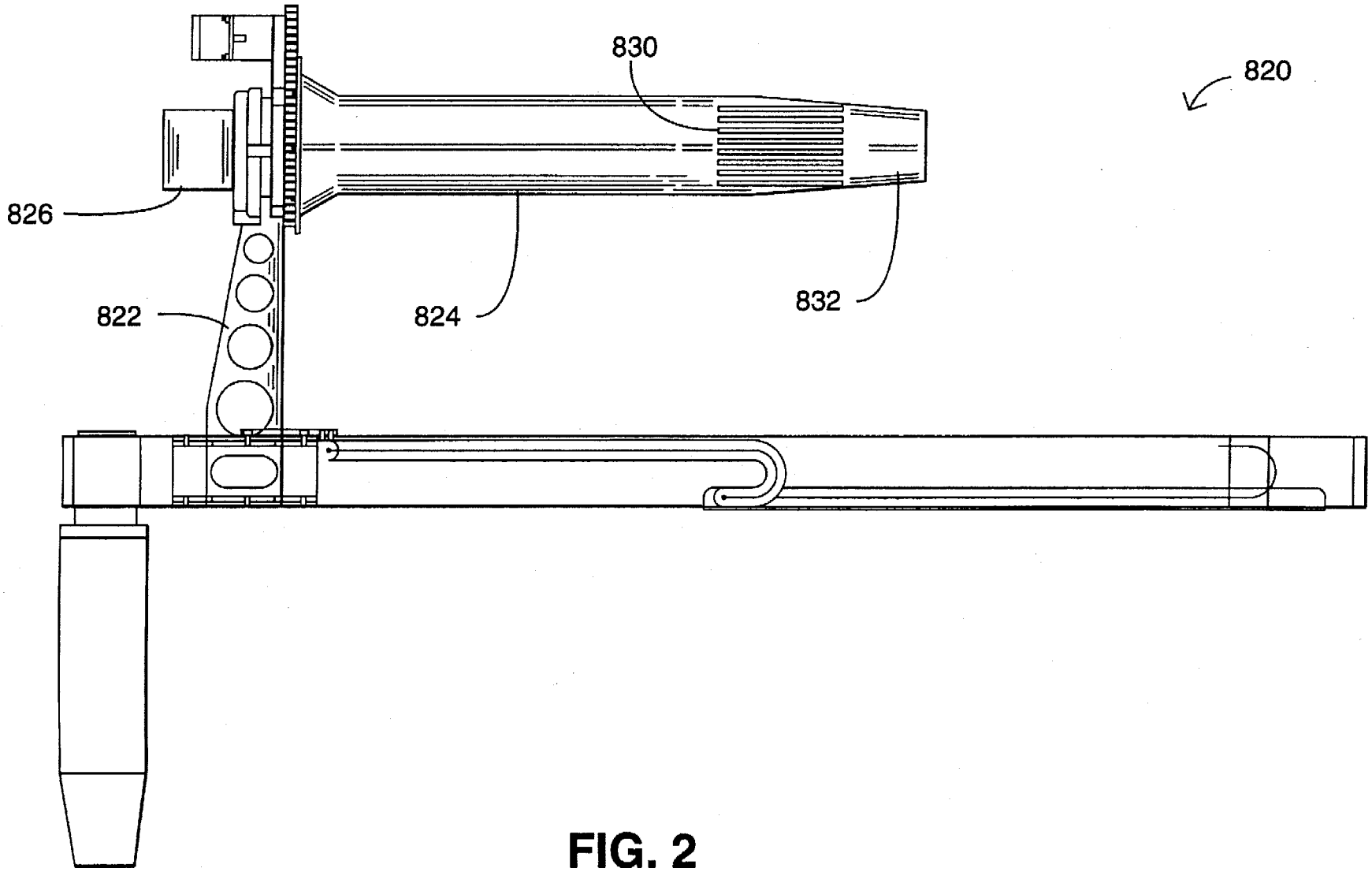
FIG. 2 is an enlarged side elevational view of the sleeve invertor shown in FIG. 1 illustrating the elongated tube.

As best seen in FIG. 2, elongated tube assembly 820 includes a frame 822 and an elongated plastic tube 824. A vacuum source 826 is attached to one end of the tube and a plurality of slots are arranged along the axial length of the other end of the tube 830. One type of vacuum source which is particularly suitable for the tube is a transvector Model 914, manufactured by VORTEC, Inc. of Cincinnati, Ohio. In the preferred embodiment, the end of the tube opposite the vacuum supply 832 is slightly tapered to improve the operation of the tube. Also in the preferred embodiment, the tube is made of a low friction plastic such as cellulose acetate butyrate. However, it would be expected that other materials such as polished aluminum would also work suitably well.

Figure 3:
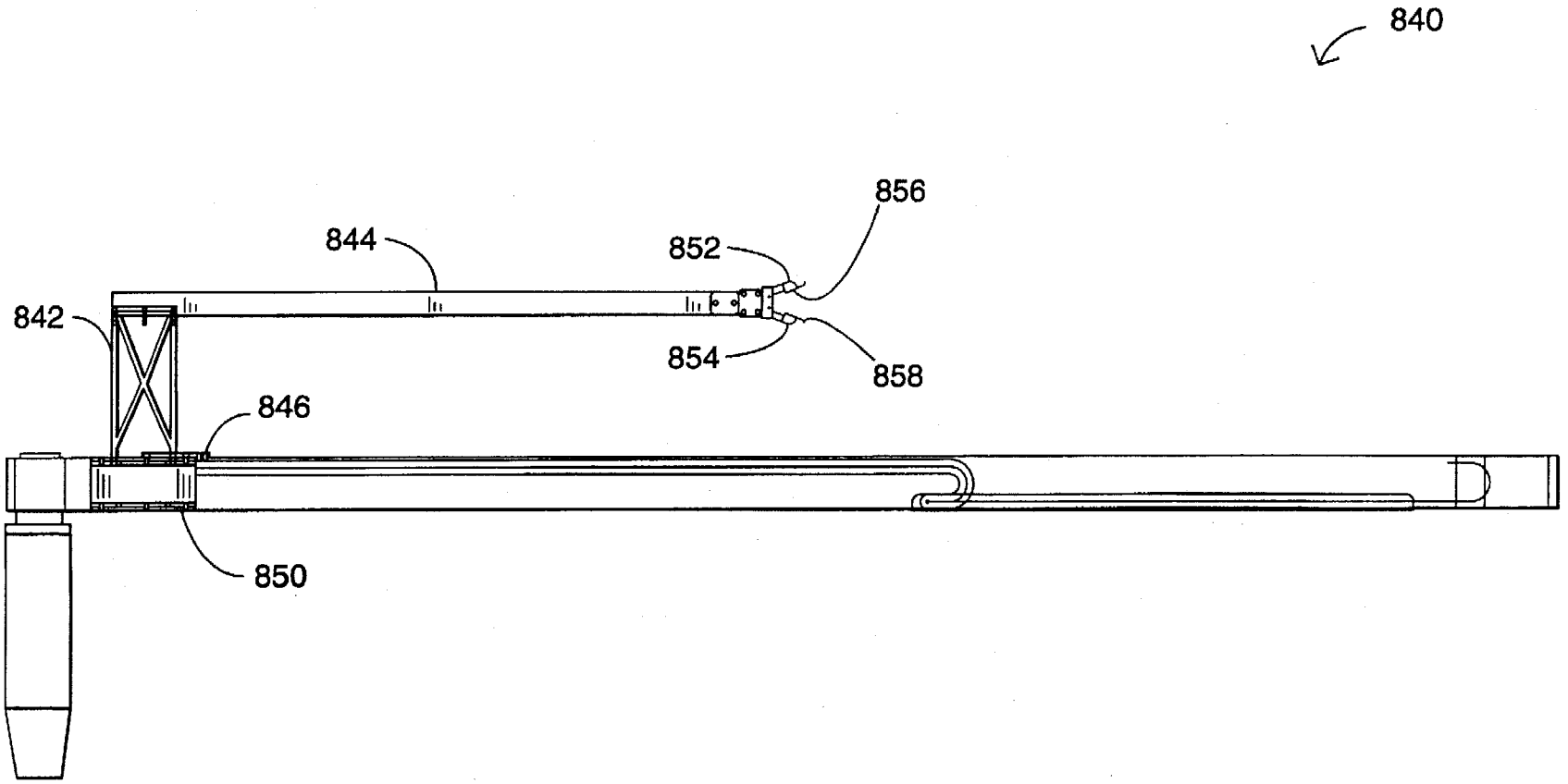
FIG. 3 is an enlarged side elevational view of the sleeve invertor shown in FIG. 1 illustrating the gripper arm.

As best seen in FIG. 3, the gripper arm assembly 840 includes a frame 842 and an elongated arm with gripper jaws 844. The frame 842 is attached to a slide 846 and a actuator 850 for moving the elongated arm with the grippers 844 from a first position inside the elongated tube assembly 820 to a second retracted position in which the garment sleeve has been pulled completely through the interior of elongated tube assembly 820. Elongated arm with gripper jaws 844 includes a pair of opposed jaws 852,854 having roughened gripping surfaces 856. Also in the preferred embodiment, wire guides 858 improve the ability of the jaws 852,854 to contact the surface of the sleeve loaded onto the elongated tube assembly 820.

Figure 4:
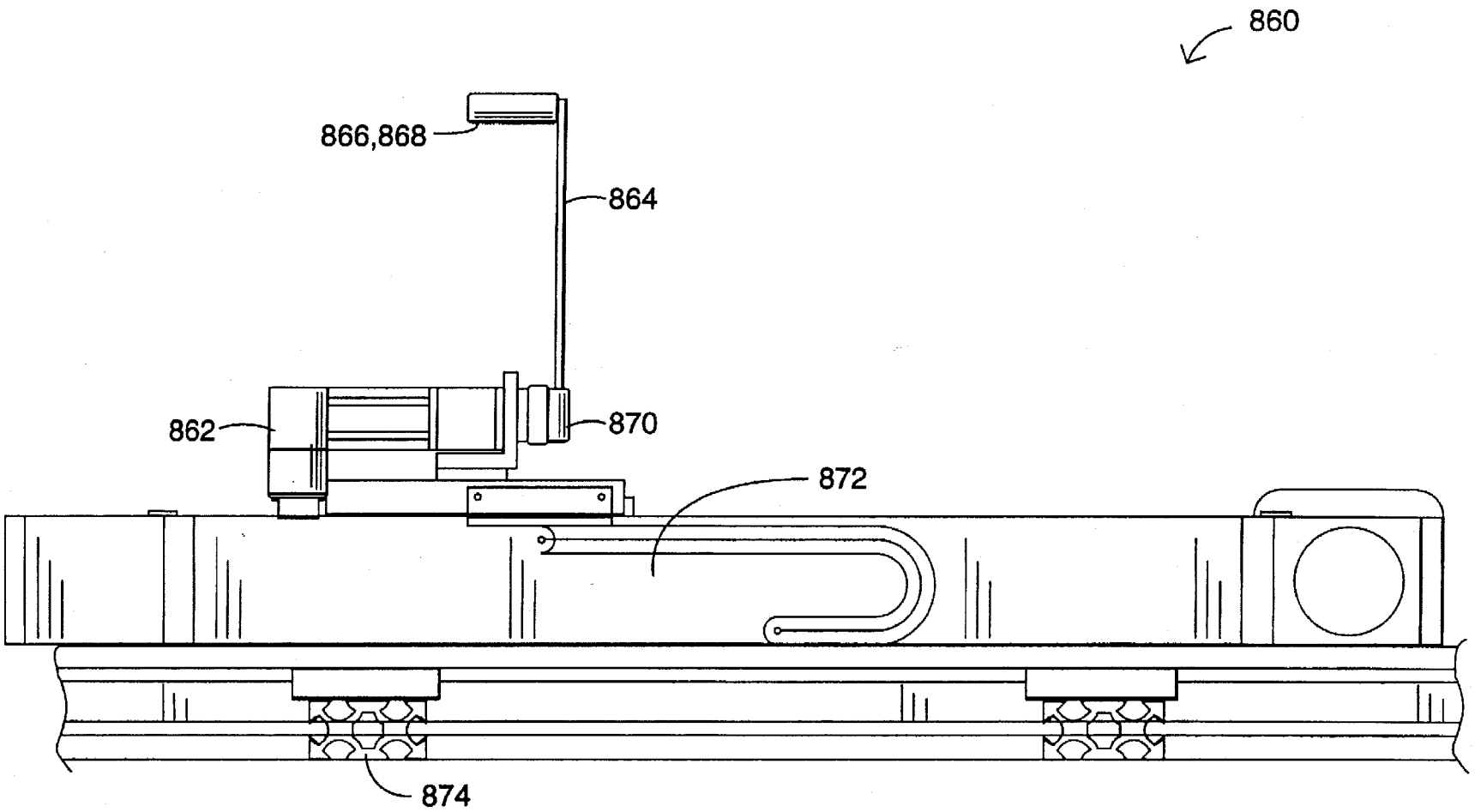
FIG. 4 is an enlarged side elevational view of the sleeve invertor shown in FIG. 1 illustrating the spreaders.
Figure 5:
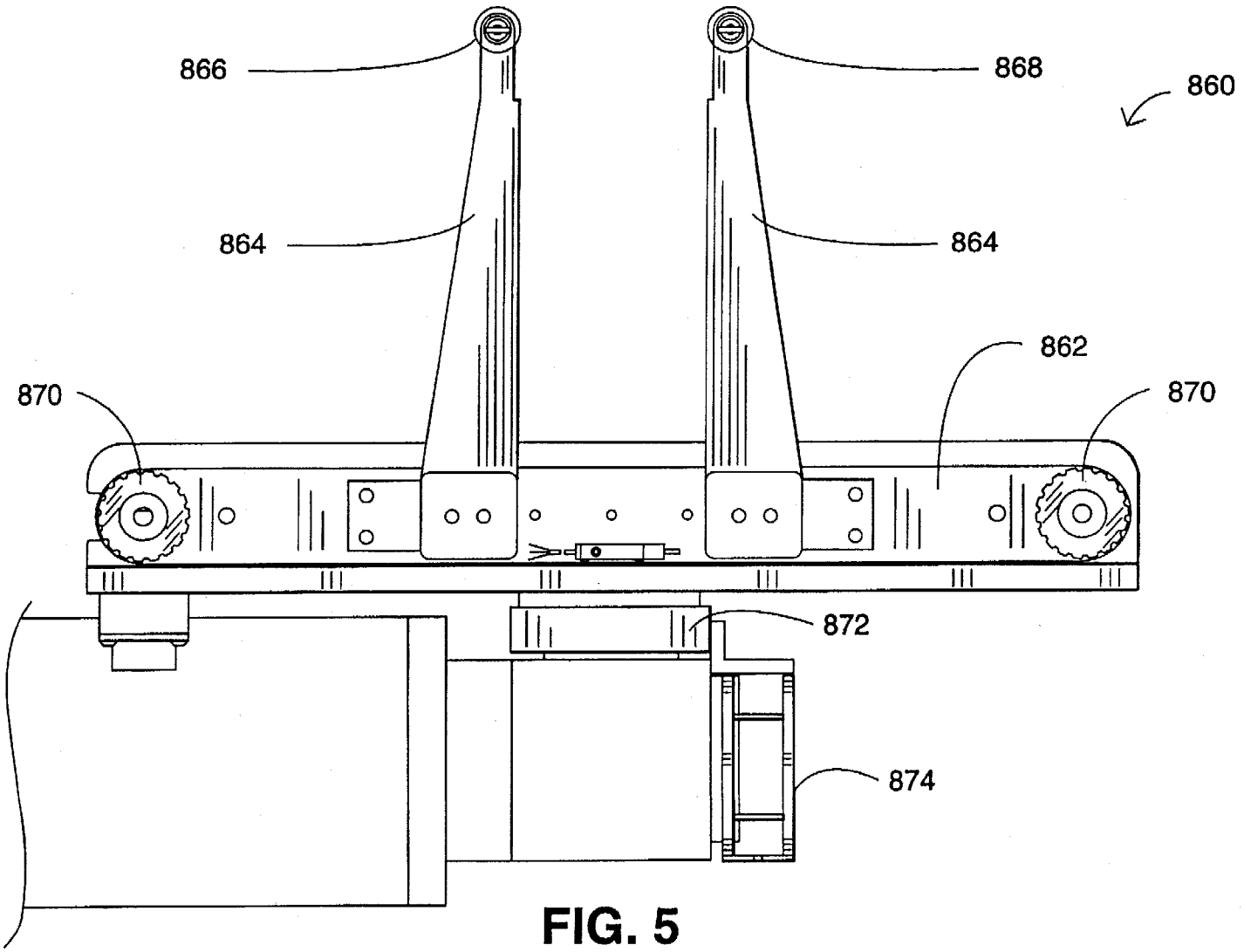
FIG. 5 is an enlarged front view of the spreaders shown in FIG. 4.

As best seen in FIGS. 4 and 5, spreader assembly 860 includes a frame 862 having a pair of opposed arms 864. Opposed arms perpendicular fingers 866,868 enter the cuff of the sleeve and spread it apart to help the gripper arm 840 locate and grab the cuff of the sleeve prior to inversion. A servo motor 870 moves the fingers 866,868 from a first position close together where they can be inserted into the cuff to a second position in which the cuff is spread, as will best be seen in FIG. 6. The frame 862 of the spreader assembly 860 is attached to a slide 872 and actuator 874 for moving it between an first position away from the open-ended sleeve to a second position in which it engages the sleeve.

Figure 6A:
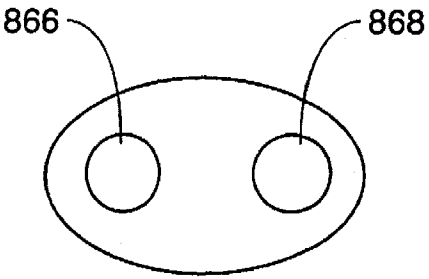
FIG. 6 is a sequential diagram of the clamping of a cuff by the opposed jaws of the gripper arm.
Figure 6B:
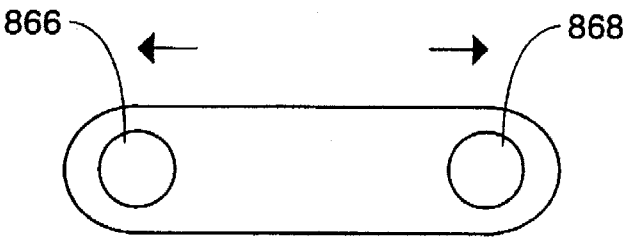
Figure 6C:
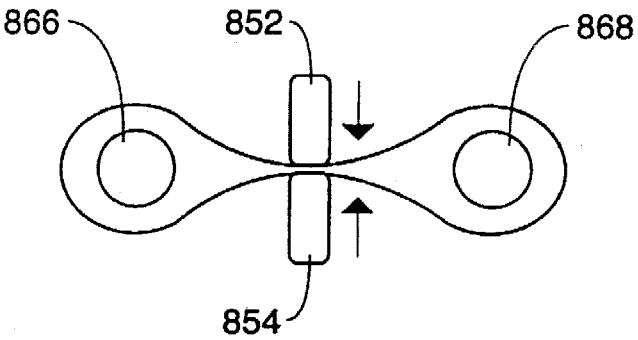

The operation of the sleeve invertor 810 can best be understood by looking at FIG. 6. After the sleeve is loaded onto the elongated tube 824, either manually or automatically, fingers 866,868 are inserted into the open end of the sleeve. The servo motor 870 is then activated and fingers 866,868 move outward causing the fabric of the cuff to be stretched tightly therebetween. This defines the position of the cuff which can be more easily grasped by jaws 852,854.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. An apparatus for automatically inverting a garment piece for a sweat suit or the like, said apparatus comprising:

(a) a frame;

(b) an elongated tube attached to said frame having a front end and a rear end for receiving said garment piece over said front end of said tube;

(c) an elongated arm located adjacent to the rear end of said tube and movable from a first position extending from the rear to the front portion of said tube to a second position rearward of said tube;

(d) gripper means attached to one end of said arm, whereby said gripper means and arm are operable to grasp and withdraw said garment piece through the front end of said tube to the rear end of said tube to automatically invert said garment piece; and (e) a spreader means for engaging said garment piece adjacent to the front end of said tube to position said garment piece for said gripper means, said spreader means including a frame, a pair of opposed arms attached at one end to said frame and oriented perpendicular to the axis of said tube, and means for moving said pair of opposed arms between a first position adjacent to one another and a second position apart from one another.

2. The apparatus according to claim 1, wherein said means for moving said pair of opposed arms between a first position adjacent to one another and a second position apart from one another includes a pair of rotary actuators attached to said frame and to said pair of opposed arms.

3. The apparatus according to claim 1, wherein said pair of opposed arms further includes a finger attached to the other end of each of said opposed arms for engaging said garment piece.

4. The apparatus according to claim 1, further including means for moving said spreader means from a first position away from the front end of said tube to a second position adjacent to the front end of said tube.

5. The apparatus according to claim 4, wherein said means for moving said spreader means from a first position away from the front end of said tube to a second position adjacent to the front end of said tube includes a slide attached to said frame and an actuator attached between said slide and said frame.

6. The apparatus according to claim 1, wherein the front end of said tube is tapered.

7. The apparatus according to claim 1, wherein said tube is formed of low-friction plastic.

8. The apparatus according to claim 1, further including a source of vacuum attached to the rear end of said tube.

9. The apparatus according to claim 8, wherein said source of vacuum attached to the rear end of said tube is a transvector.

10. The apparatus according to claim 8, wherein the front end of said tube includes a plurality of slots.

11. The apparatus according to claim 10, wherein said plurality of slots are axially aligned with respect to said tube.

12. An apparatus for automatically inverting a garment piece for a sweat suit or the like, said apparatus comprising:

(a) a frame;

(b) an elongated tube attached to said frame having a front end and a rear end for receiving said garment piece over said front end of said tube;

(c) a gripper arm located adjacent to the rear end of said tube and axially aligned with said tube, said gripper arm including: (i) a frame; (ii) an elongated arm attached to said frame at one end; (iii) gripping means attached to the other end of said elongated arm; and (iv) means for moving said arm and said gripping means from a first position away from said garment piece to a second position adjacent to said garment piece;

(d) spreader means for engaging said garment piece adjacent to the front end of said tube to position said garment piece for said gripper means, whereby said gripper means and arm are operable to grasp and withdraw said garment piece through the front end of said tube to the rear end of said tube to automatically invert said garment piece.

13. The apparatus according to claim 12, wherein said spreader means includes a frame, a pair of opposed arms attached at one end to said frame and oriented perpendicular to the axis of said tube, and means for moving said pair of opposed arms between a first position adjacent to one another and a second position apart from one another.

14. The apparatus according to claim 13, wherein said means for moving said pair of opposed arms between a first position adjacent to one another and a second position apart from one another includes a pair of rotary actuators attached to said frame and to said pair of opposed arms.

15. The apparatus according to claim 13, wherein said pair of opposed arms further includes a finger attached to the other end of each of said opposed arms for engaging said garment piece.

16. The apparatus according to claim 12, further including means for moving said spreader means from a first position away from the front end of said tube to a second position adjacent to the front end of said tube.

17. The apparatus according to claim 16, wherein said means for moving said spreader means from a first position away from the front end of said tube to a second position adjacent to the front end of said tube includes a slide attached to said frame and an actuator attached between said slide and said frame.

18. The apparatus according to claim 12, wherein the front end of said tube is tapered.

19. The apparatus according to claim 12, wherein said tube is formed of low-friction plastic.

20. The apparatus according to claim 12, further including a source of vacuum attached to the rear end of said tube.

21. The apparatus according to claim 20, wherein said source of vacuum attached to the rear end of said tube is a transvector.

22. The apparatus according to claim 20, wherein the front end of said tube includes a plurality of slots.

23. The apparatus according to claim 12, wherein said plurality of slots are axially aligned with respect to said tube.

24. The apparatus according to claim 12, wherein said gripping means includes a pair of opposed jaws.

25. The apparatus according to claim 24, wherein said pair of opposed jaws includes a gripping surface on each of said opposed jaws for engaging said garment piece.

26. The apparatus according to claim 24, wherein said pair of opposed jaws includes a pair of wire guides adjacent to each of said opposed jaws for guiding said garment piece between said opposed jaws.

27. The apparatus according to claim 12, wherein said means for moving said arm and said gripping means from a first position away from said garment piece to a second position adjacent to said garment piece includes a slide attached to said frame and an actuator attached between said slide and said frame.

28. A method for automatically inverting a garment piece for a sweat suit or the like, said method comprising the steps of:

(a) receiving said garment piece over a front end of an elongated tube attached to a frame having a front end and a rear end;

(b) spreading said garment piece adjacent to the front end of said tube to position said garment piece by inserting two members into said garment piece and moving said members away from one another;

(c) gripping said garment piece where spread; and (d) withdrawing said garment piece through the front end of said tube to the rear end of said tube to automatically invert said garment piece.

29. An apparatus for automatically inverting a garment piece for a sweat suit or the like, said apparatus comprising:

(a) a frame;

(b) an elongated tube attached to said frame having a front end and a rear end for receiving said garment piece over said front end of said tube;

(c) an elongated arm located adjacent to the rear end of said tube and axially aligned with said tube and movable from a first position extending from the rear to the front portion of said tube to a second position rearward of said tube;

(d) gripper means attached to one end of said arm, whereby said gripper means and arm are operable to grasp and withdraw said garment piece through the front end of said tube to the rear end of said tube to automatically invert said garment piece; and (e) a source of vacuum attached to the rear end of said tube.

30. The apparatus according to claim 29, further including spreader means for engaging said garment piece adjacent to the front end of said tube to position said garment piece for said gripper means.

31. The apparatus according to claim 30, wherein said spreader means includes a frame, a pair of opposed arms attached at one end to said frame and oriented perpendicular to the axis of said tube, and means for moving said pair of opposed arms between a first position adjacent to one another and a second position apart from one another.

32. The apparatus according to claim 31, wherein said means for moving said pair of opposed arms between a first position adjacent to one another and a second position apart from one another includes a pair of rotary actuators attached to said frame and to said pair of opposed arms.

33. The apparatus according to claim 31, wherein said pair of opposed arms further includes a finger attached to the other end of each of said opposed arms for engaging said garment piece.

34. The apparatus according to claim 30, further including means for moving said spreader means from a first position away from the front end of said tube to a second position adjacent to the front end of said tube.

35. The apparatus according to claim 34, wherein said means for moving said spreader means from a first position away from the front end of said tube to a second position adjacent to the front end of said tube includes a slide attached to said frame and an actuator attached between said slide and said frame.

36. The apparatus according to claim 29, wherein said source of vacuum attached to the rear end of said tube is a transvector.

37. The apparatus according to claim 29, wherein the front end of said tube includes a plurality of slots.

38. The apparatus according to claim 37, wherein said plurality of slots are axially aligned with respect to said tube.

* * * * *